US005655648A

United States Patent [19]

Rosen et al.

[11] Patent Number: 5,655,648

[45] Date of Patent: Aug. 12, 1997

[54] MODULAR ACCESSORY MECHANICAL LOCK-OUT MECHANISM

[75] Inventors: James L. Rosen, West Hartford; Raymond K. Seymour, Plainville; Roger N. Castonguay, Terryville, all of Conn.

[73] Assignee: General Electric Company, New York, N.Y.

[21] Appl. No.: 640,634

[22] Filed: May 1, 1996

[51] Int. Cl.[6] ..... H01H 5/00

[52] U.S. Cl. ..... 200/401; 200/400; 335/167

[58] Field of Search ..... 200/400, 401; 335/167, 168, 169, 170–176

[56] References Cited

U.S. PATENT DOCUMENTS

| | | | |
|---|---|---|---|
| 4,001,739 | 1/1977 | Powell et al. | 335/34 |
| 4,672,501 | 6/1987 | Bilac et al. | 361/96 |
| 5,424,701 | 6/1995 | Castonguay et al. | 335/172 |
| 5,486,667 | 1/1996 | Castonguay et al. | 200/400 |
| 5,488,211 | 1/1996 | Castonguay et al. | 200/400 |
| 5,489,755 | 2/1996 | Castonguay et al. | 200/400 |
| 5,502,286 | 3/1996 | Pollman et al. | 200/401 |
| 5,504,290 | 4/1996 | Boginski et al. | 200/400 |
| 5,512,720 | 4/1996 | Coudert et al. | 200/400 |

OTHER PUBLICATIONS

U.S. Application No. 08/248,900 filed 25 May 1994.

U.S. Application No. 08/266,409 filed 27 Jun. 1994.

*Primary Examiner*—David J. Walczak

*Attorney, Agent, or Firm*—Richard A. Menelly; Carl B. Horton

[57] ABSTRACT

A combined bell alarm and lock-out accessory is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset. The circuit breaker lock-out mechanism interfaces between the circuit breaker operating mechanism and the accessory to insure that the contacts remain open until the accessory is completely reset.

9 Claims, 3 Drawing Sheets

MODULAR ACCESSORY MECHANICAL LOCK-OUT MECHANISM

BACKGROUND OF THE INVENTION

U.S. Pat. No. 5,488,211 entitled "A Latching Arrangement for High Ampere-rated Circuit Breaker Operating Springs" describes a combined bell alarm and lock-out accessory that is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset. U.S. patent application Ser. No. 08/248,900 filed May 25, 1994 entitled "Accessory Compartment for High Ampere-rated Circuit Breaker" relates to a high ampere-rated circuit breaker that meets the electrical code requirements of the world market. The circuit breaker electronic trip unit is contained within a recess in the circuit breaker cover and is interlocked with the circuit breaker operating mechanism to articulate the operating mechanism upon removal. The accessory units are contained within an adjoining accessory compartment recess within the circuit breaker cover.

U.S. Pat. No. 5,502,286 entitled "Bell Alarm and Lock-out for High Ampere-rated Circuit Breakers" describes a combined bell alarm and lock-out accessory that is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset.

U.S. patent application Ser. No. 08/266,409 filed Jun. 27, 1994 entitled "Interlock Arrangement for High Ampere-rated Circuit Breaker Operating Springs" relates to a high ampere-rated circuit breaker which meets the electrical code requirements of the world market. The charging of the powerful operating springs controlling the circuit breaker contacts is made manually by means of a ratchet and pawl assembly. A two stage latching arrangement controls the retention and release of the pawl to retain and discharge the operating springs. The latches are interlocked with the operating springs drive shaft to prevent the discharge of the operating springs when the contacts are in the closed condition.

An early use of accessories within high ampere-rated circuit breakers is described within U.S. Pat. No. 4,001,739 entitled "Circuit Breaker with Bell Alarm and Breaker Lockout Accessory." The circuit breaker contacts are interlocked with the accessories by insuring that the circuit breaker contact closing springs cannot be reset until the associated accessory is reset, i.e. becomes operational.

When such accessories, as described above, are used within industrial applications and have to be reset for future operation, it is desirable to insure that the associated circuit breaker contact closing springs are capable of being immediately reset. However, it is important that the circuit breaker contacts are not closed to turn on the circuit breaker unless and until the accessory has become reset and operational.

One purpose of the instant invention is to provide a circuit breaker lock-out mechanism that interacts with the circuit breaker operating mechanism latch assembly to prevent the circuit breaker contacts from being closed until and unless the associated accessory becomes reset.

SUMMARY OF THE INVENTION

A circuit breaker lock-out mechanism interfaces between the circuit breaker operating mechanism latch assembly and the interlocked accessory to insure that the circuit breaker contacts remain open until the accessory is completely reset. An interlock link positioned between the operating mechanism trip lever and the accessory lockout arm prevent release of the circuit breaker trip lever from the latch assembly until the accessory has been reset.

DESCRIPTION OF THE PREFERRED EMBODIMENT

Figure 1:
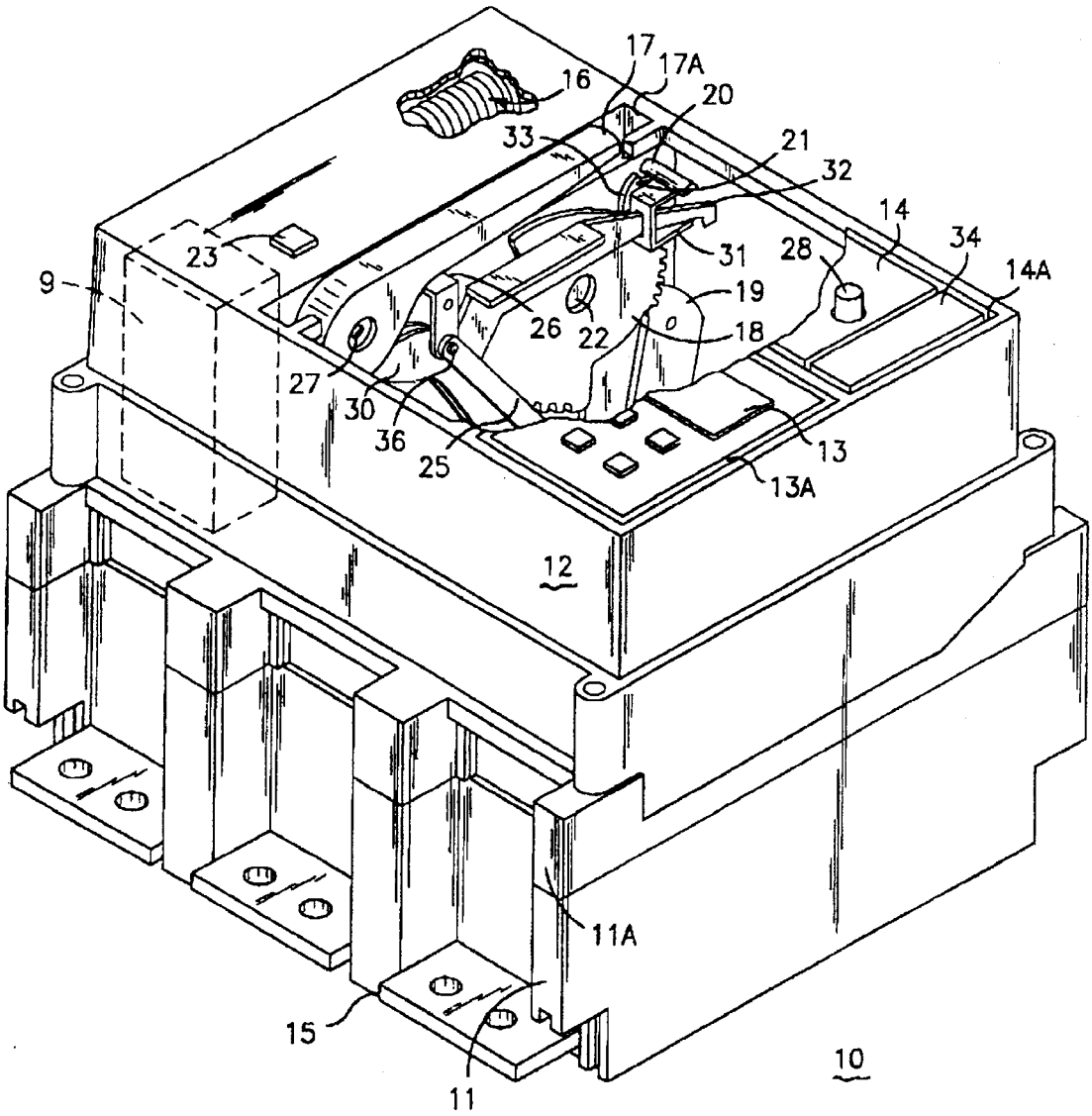
FIG. 1 is a top perspective view of a high ampere rated circuit breaker with part of the cover removed to depict the accessory interlock arrangement according to the invention.

The high ampere-rated circuit breaker 10 shown in FIG. 1 is described in U.S. Pat. No. 5,424,701 entitled "Operating Mechanism for High Ampere-rated Circuit Breakers" and is capable of transferring several thousand amperes quiescent circuit current at several hundred volts potential without overheating. The circuit breaker consists of an electrically insulated base 11 to which an intermediate cover 11A of similar insulative material is attached prior to attaching the top cover 12, also consisting of an electrically-insulative material. The operating mechanism 9 as described within the aforementioned U.S. Pat. No. 5,424,701 controls the condition of the circuit breaker contacts. Electrical connection with the interior current-carrying components is made by load terminal straps 15 extending from one end of the base and line terminal straps (not shown) extending from the opposite end thereof. The interior components are controlled by an electronic trip unit 13 contained within a recess 13A on the top surface of the top cover 12. The trip unit 13 is similar to that described within U.S. Pat. No. 4,672,501 and interacts further with the bell alarm and lock-out accessory 14 and the undervoltage release accessory 34 contained within the accessory recess 14A. The reset button 28 extending from the top of the bell alarm and lock-out accessory serves to provide reset function to the accessory as well as indication as to whether the circuit breaker operating mechanism is operative. Close button 23 accessible from the top cover allow manual operation of the circuit breaker operating mechanism to separate the circuit breaker contacts. An operating handle 17 within the handle recess 17A allows the circuit breaker operating mechanism to be manually reset after automatic separation of the circuit breaker contacts.

In the operating mechanism as described within U.S. Pat. No. 5,486,667 entitled "Rating Module Unit for High Ampere-rated Circuit Breaker", the operating handle 17 allows manual operation of the circuit breaker operating mechanism 9 as well as providing manual means for charging the operating mechanism springs 16. The handle 17 is attached to the operating mechanism sideframe 33 by means of the handle pivot pin 27 and is connected with the handle drive gear 18 by a pair of handle drive links 30. The handle drive gear interacts with a locking pawl 19 to restrain the handle drive gear from reverse rotation during the operating springs charging process as described in U.S. Pat. No. 5,489,755 entitled "Handle Operator Assembly for High Ampere-rated Circuit Breaker". The two stage operating springs latching assembly consisting of the primary latch 20 and intermediate latch 21 interact to prevent rotation of the closing shaft 22 while the operating springs are being charged. In accordance with the teachings of the invention, the operating springs 16 are prevented from becoming released to move the circuit breaker contacts to the CLOSE position, until the bell alarm and lock-out accessory 14 has been reset, by means of the interlock link 25 that is pivotally attached to the U-shaped closing arm 26 at one end by means of a pivot 36. The closing arm includes a first end which is accessible from the cover 12, under the operating handle 17 within the handle slot 17A. The interlock link interacts with the accessory lock-out arm 39 in the manner best seen by now referring to FIGS. 2 and 3.

Figure 2:
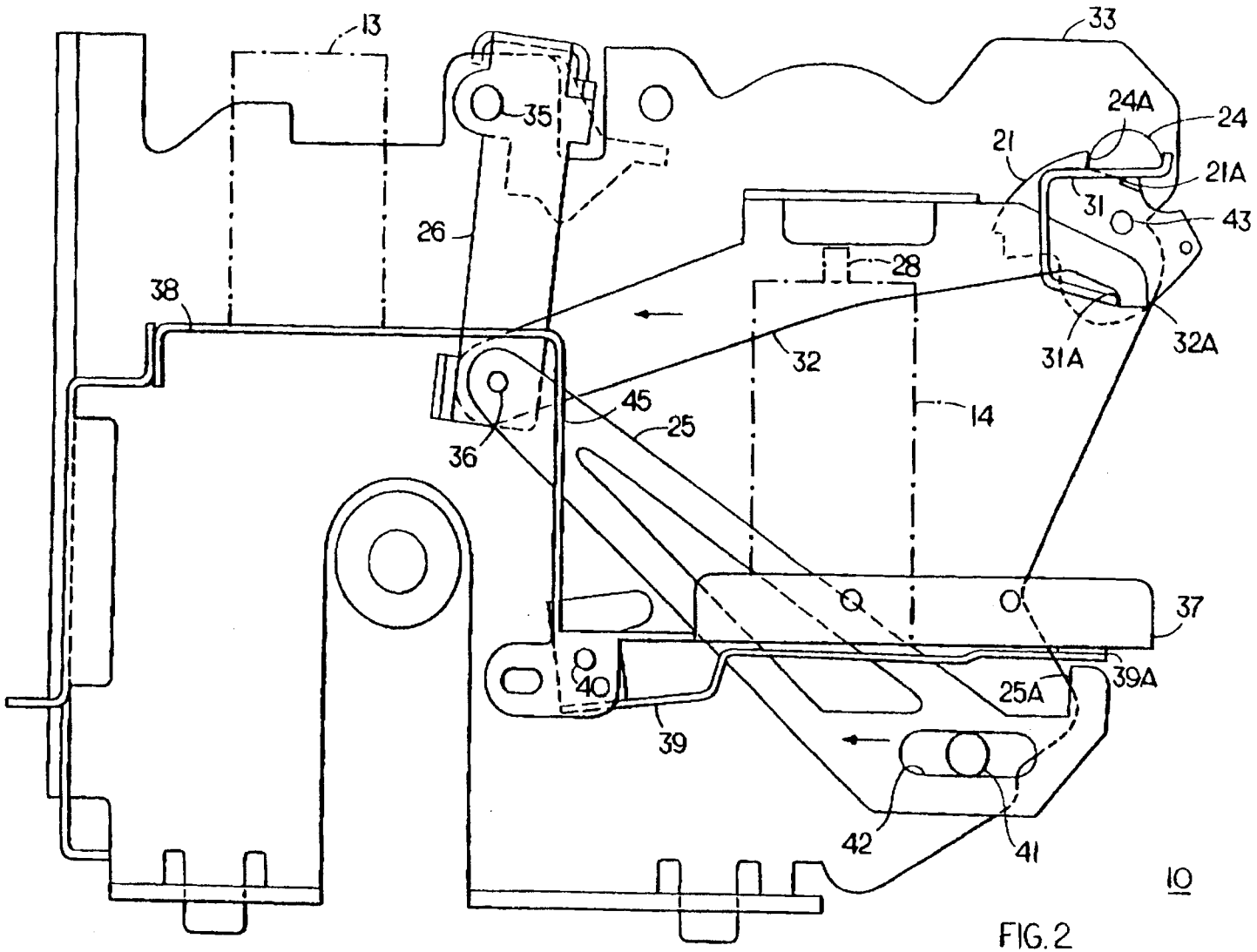
FIG. 2 is an enlarged plan side view of a part of the interior of the circuit breaker of FIG. 1 to depict the accessory interlock arrangement of FIG. 1 in an interlocked condition.

In the circuit breaker 10 depicted in FIG. 2, the trip unit 13 and the combined bell alarm and lock-out accessory 14, are depicted in phantom to show their positional relationship to the accessory support carrier 37 and the trip unit support carrier 38, depicted in solid lines. The U shaped closing arm 26 is pivotally attached to the side frame 33 by means of the pivot 35 and to the closing link 32 by means of the pivot 36 that also attaches the interlock link 25. As described in the aforementioned U.S. Pat. No. 5,521,346 entitled "Interlock Arrangement for High Ampere-rated Circuit Breaker Operating Springs", the operating mechanism is prevented from closing the circuit breaker contacts by the primary latch 24, intermediate latch 21 and the latch arm 31. The primary latch 24 as shown in FIG. 2 is depicted in the release position which allows the operating springs 16 of FIG. 1 to become released to close the circuit breaker contacts. Primary latch 24 is rotated in a clockwise direction to the position shown in FIG. 2 by the interaction of surface 32A on closing link 32 and surface 31A on latch arm 31 when closing link 32 is driven in a reverse direction as indicated. Closing link 32 is driven in the reverse direction when close button 23 shown in FIG. 1 is depressed. This, in turn, rotates the closing arm 26 in a clockwise direction, thereby forcing the closing link to move in the reverse direction. The interlock link 25 also moves in a reverse direction when the close button 23 is depressed. With the associated bell alarm and lock out accessory 14 in the reset condition shown in FIG. 2, the accessory lockout arm 39 is spring-loaded against the bottom of the accessory support carrier 37 and the end 39A of the accessory lockout arm 39 is out of contact with the end 25A of the interlock link 25 which allows the interlock link to move in response to operation of the U-shaped closing arm 26 and slide along the guide pin 41 which is attached to the side frame 33 and is captured within the elongated slot 42 formed within the interlock link 25. The accessory lock-out arm 39 is pivotally attached to the junction between the wall 45 that connects between the trip unit support carrier 38 and the accessory support carrier 37, by means of the pivot pin 40. The transfer of the interlock link via the slot 42 and pin 41 in the indicated direction, allows the rotation of the intermediate latch 21 in the counterclockwise direction about pivot 43 allowing the surface 21A of the intermediate latch 21 to rotate away from the surface 24A of the primary latch 24 allowing the operating springs to close the circuit breaker contacts The interlock link 25 and accessory lock-out arm 39 operate in a similar manner when the accessory is an undervoltage release accessory 34 shown earlier in FIG. 1.

Figure 3:
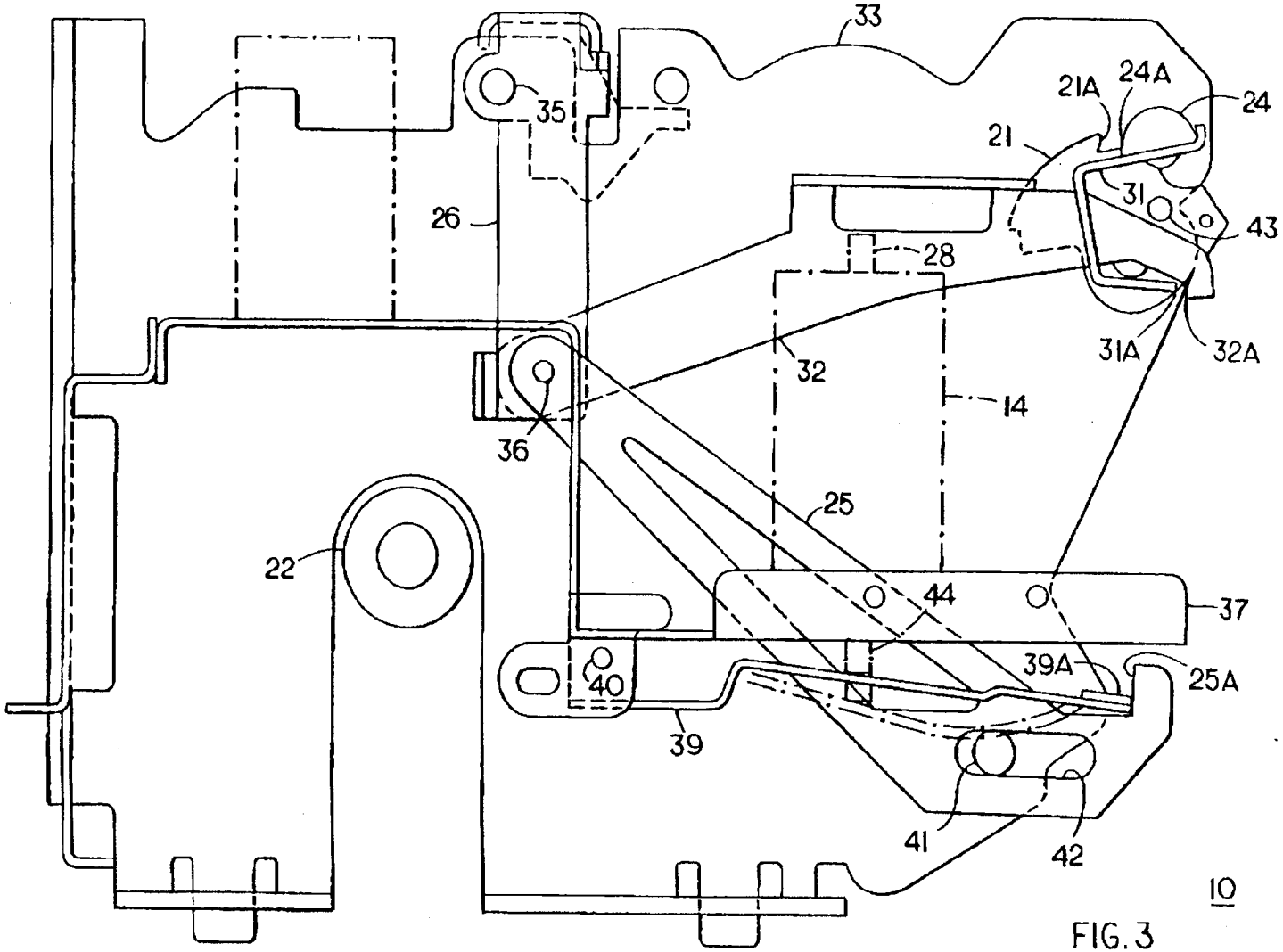
FIG. 3 is an enlarged plan side view of the accessory interlock arrangement of FIG. 2 in a released condition.

The latched condition of the circuit breaker 10 is depicted in FIG. 3 with the U-shaped closing arm 26 rotated back to its home position, with the surface 21A of the intermediate latch 21 in contact with the primary latch surface 24A of the primary latch 24 and with the end 32A of the trip lever 32 away from the end 31A of the latch arm 31. With the bell alarm and lock out accessory 14 in the activated condition, the accessory lockout arm 39 is trapped away from the bottom of the accessory support carrier 37 by capture between the end 25A of the interlock link 25 and the end 39A of the accessory lock out arm 39. In this condition, the guide pin 41 is at the end of the elongated slot 42 and the rotation of the U-shaped closing arm 26 is thereby prevented. Upon depressing the reset button 28 on the top of the bell alarm and lock out accessory 14, to reset the accessory, the post 44 is forced out of contact with the lockout arm 39, thereby releasing the end 39A of the lockout arm 39 away from the end 25A of the interlock link 25. This allows the accessory lockout arm 39 to spring back to the reset position against the bottom of the accessory support carrier 37 as shown in FIG. 2 to thereby allow closing arm 26 to rotate in the clockwise direction and allow release of the closing springs to close the circuit breaker contacts.

We claim:

1. An industrial-rated circuit breaker for high level overcurrent protection comprising:

an insulative base and an insulative cover;

an operating mechanism in said base connecting between a pair of sideframes and controlled by an electronic trip unit arranged within said cover to open and close a pair of contacts;

a closing arm having a first end accessible from said cover, said closing arm adapted for articulating said operating mechanism for release of a closing spring to close said contacts;

an accessory unit arranged within said cover, said accessory unit including reset means to allow reset of said accessory unit after said accessory unit has become actuated; and interlock means within said cover interacting with said operating mechanism and said accessory unit preventing said operating mechanism from closing said contacts until said accessory unit is reset, said interlock means including a interlock link pivotally connected at a first end with said closing arm, said interlock means further including a lockout arm interacting with a second end of said interlock link remote from said first end.

2. The industrial-rated circuit breaker of claim 1 wherein said accessory unit is supported on an accessory carrier, said lockout arm extending subjacent said accessory carrier and spring-loaded against a bottom of said accessory carrier.

3. The industrial-rated circuit breaker of claim 2 wherein said interlock link includes an elongated slot arranged on a support pin extending from one of said sideframes.

4. The industrial-rated circuit breaker of claim 1 wherein said interlock link includes means on said second end for capturing an adjoining end of said lockout arm when said accessory limit is in an actuated condition.

5. The industrial-rated circuit breaker of claim 4 wherein said accessory unit further includes post extending from a bottom thereof for contacting said lockout arm and releasing said adjoining end of said lockout arm from said interlock link when said accessory unit is in a reset condition.

6. The industrial-rated circuit breaker of claim 4 further including a closing link connecting with said closing arm and said interlock link at a first end, and interacting with a latch arm at a second end opposite said first end thereof.

7. The industrial-rated circuit breaker of claim 6 wherein said closing link and said interlock link are connected with said closing arm by means of a common pivot.

8. The industrial-rated circuit breaker of claim 1 wherein said accessory unit comprises a combined bell alarm and lockout unit.

9. The industrial-rated circuit breaker of claim 1 wherein said accessory unit comprises an undervoltage release accessory unit.

* * * * *